US005180444A

United States Patent [19]

Finkl et al.

[11] Patent Number: 5,180,444

[45] Date of Patent: Jan. 19, 1993

[54] METHOD FOR CONTROLLED FLUID QUENCHING OF STEEL

[75] Inventors: Charles W. Finkl, Evanston; Nicholas Cerwin, Palatine, both of Ill.

[73] Assignee: A. Finkl & Sons Co., Chicago, Ill.

[21] Appl. No.: 247,806

[22] Filed: Sep. 21, 1988

[51] Int. Cl.[5] ..... C21D 1/18

[52] U.S. Cl. ..... 148/660; 148/540

[58] Field of Search ..... 266/249, 46, 251, 259, 266/111, 102, 287; 148/143, 153, 155, 157, 13.1, 14

[56] References Cited

U.S. PATENT DOCUMENTS 4,093,195 6/1978 Schwalm ..... 266/251

4,582,301 4/1986 Wunning ..... 266/259

FOREIGN PATENT DOCUMENTS 645002 5/1937 Fed. Rep. of Germany ..... 266/259

OTHER PUBLICATIONS

Metals Handbook vol. 4 Heat Treating 9th ed ©1981 pp. 46, 58-59, 589-591 599-602.

*Primary Examiner*—R. Dean

*Attorney, Agent, or Firm*—James G. Staples

[57] ABSTRACT

A series of controlled quenching of elevated temperature steel work pieces includes locating hot work pieces on a support at distances from one another sufficient to avoid slack quenching and subjecting the work pieces to a forced draft at a speed which results in consistent uniformity of hardness and uniformity of grain size of which about 10 MPH is exemplary, and an apparatus therefore which provides two pass cooling so that minimum horsepower is used and environmental degradation is avoided.

5 Claims, 3 Drawing Sheets

METHOD FOR CONTROLLED FLUID QUENCHING OF STEEL

This invention relates generally to methods and apparatus for quenching steels to attain desirable properties and, more specifically, to methods and apparatus for controlled pneumatic quenching, usually by air, of such steels, which quenching may optionally be supplemented by a partial liquid quench used conjointly therewith.

BACKGROUND AND SUMMARY OF THE INVENTION

Certain steels require very consistent uniformity of hardness and uniformity of grain structure. Such steels often have chemistries which make the attainment of these properties exceedingly difficult by conventional air or liquid quench methods. For example, certain steels such as tool steels and other steels intended for specialized applications require high hardness and excellent mechanical properties. These requirements in turn dictate the presence of substantial amounts of alloying elements. However, the substantial alloy contents make attaining the requirements of high hardness and excellent mechanical properties difficult to obtain by conventional methods of manufacture. Thus, steels which have the chemistries corresponding to the attainment of high hardness often lack the attributes of retention of that hardness following a relatively low temperature stress relief treatment. The end result is less than desired mechanical properties.

As another example, air hardening tool steels, if water quenched, generally crack. As a consequence, chemistries of this type of steel require a very high quality of air quench in order to maximize hardness and mechanical properties. Thus, it will be noted that there are at least two types of steels that require the best air quench possible: (1) tool steels with significant alloy contents which tend to crack on water quenching; and (2) steel chemistries wherein the requirements of high hardness and desired mechanical properties dictate very low tempering temperatures (which can make the steel brittle). The brittle condition generally requires the use of stronger chemistries to permit higher tempering temperatures with the result that water quenching may have to be eliminated all together.

In addition to the special situations described above, the conventional mode of air quenching, including forced draft air quenching as that term is currently understood, does not always yield the desired results required in air quench steels intended for use in more generalized applications. Forced draft air quenching as that concept is currently practiced involves austenitizing steel pieces and then placing them on the shop floor, either in a pile of spread out, and thereafter permitting the pieces to self-cool or be subjected to a fan located nearby which blows a draft of air onto or across the pieces.

This technique has several drawbacks. One is the fact that adjacent pieces often slack quench one another which amounts, in essence, to an irregular quench pattern which in turn results in differing properties from location to location on the same piece of steel. This is believed attributable to the hot spots which occur at those discrete locations on separate pieces which are disposed closest and in direct juxtaposition to one another, and the further fact that scale which forms on the surface during quenching is retained in place, which scale further disturbs the regularity of the cooling pattern.

The result of these deficiencies of current methods is a large percentage of re-heat treatments, often referred to as retreats, and redraws. Indeed, a retreat rate of 1.8 times has been experienced in one shop which practices strict adherence to conventional standards.

A further concern of all specialty steel makers is the challenge presented by higher and higher standards for steel imposed by certain industries. By way of example, the die casting industry is turning more and more to the H13 Premium grade. Chrysler Automotive Corporation has developed a specification for an ultra-clean H13 steel. These steels, until now, were thought to require a double melting process, usually the vacuum arc remelt (VAR) process. Such double melting, while yielding excellent product, as contrasted to most single melting processes, is quite costly. A consistently fine grained, non-segregated product is produced, the latter characteristic being attributable to the rapid second cooling in the VAR process; i.e.: the solidification is so rapid that there is insufficient time for alloy segregation to take place, and hence a high percentage of the alloys are retained within the grain boundaries.

It has been found, however, that when the single melting process inherent in the vacuum arc degassing process is practiced with care, and this invention is practiced in conjunction therewith, the H13 Premium and Chrysler Automotive Corporation specifications can be approached, and will be met, without the need to resort to the more expensive and time consuming double melt VAR process. Indeed, the use of the present invention in conjunction with the vacuum arc degassing process has resulted in a steel which meets all H13 standards with the exception of the Type D inclusion rating, as to which the present invention has yielded a rating of 1½ instead of the required 1 on a scale of 5.

This invention overcomes the above described problems and others, and produces steel parts having consistent uniformity of hardness and consistently desirable grain structures by the application of a forced draft of air, or other gaseous quench medium, to parts which are so arranged with respect to one another as to eliminate slack quenching.

In addition, the forced draft cooling of this invention results in less warpage than is experienced with drastic quenches while, at the same time, providing the above advantages. This is particularly important to the die industry which, up to now, has usually had to sink and then harden to be sure of perfectly flat surfaces in the final die.

The advantages of the present invention can be supplemented by use of a special liquid quench. Specifically, parts may be first liquid quenched to an interim temperature level, and thereafter immediately subjected to the forced air quench described herein to attain a slow, uniform temperature reduction which yields the desired martinsitic microstructure.

Accordingly, an object of this invention is to provide a method and apparatus for forced draft cooling of steel work pieces which results in a high degree of consistency of uniformity of hardness and consistency of grain structure.

Another object is to provide a method and apparatus of quenching entirely or significantly by forced air cooling which eliminates problems common to conventional still air or forced air methods, including such problems as slack quenching.

Another object is to provide a method and apparatus of forced air quenching of steel parts which will significantly contribute to the attainment of VAR quality steel using the single melting vacuum arc degassing process, thereby eliminating a second melting and the use of specialized equipment.

A further object is to provide a method and apparatus of air quenching which produces product in which alloy segregation and other deleterious attributes of single melt melting processes are eliminated or substantially reduced.

These and other objects and advantages of the invention will be apparent from the following exemplary description of a currently preferred mode of practicing the invention.

BRIEF DESCRIPTION OF THE DRAWING

The invention is illustrated more or less diagrammatically in the accompanying drawing wherein.

DETAILED DESCRIPTION OF THE INVENTION

Figure 1:
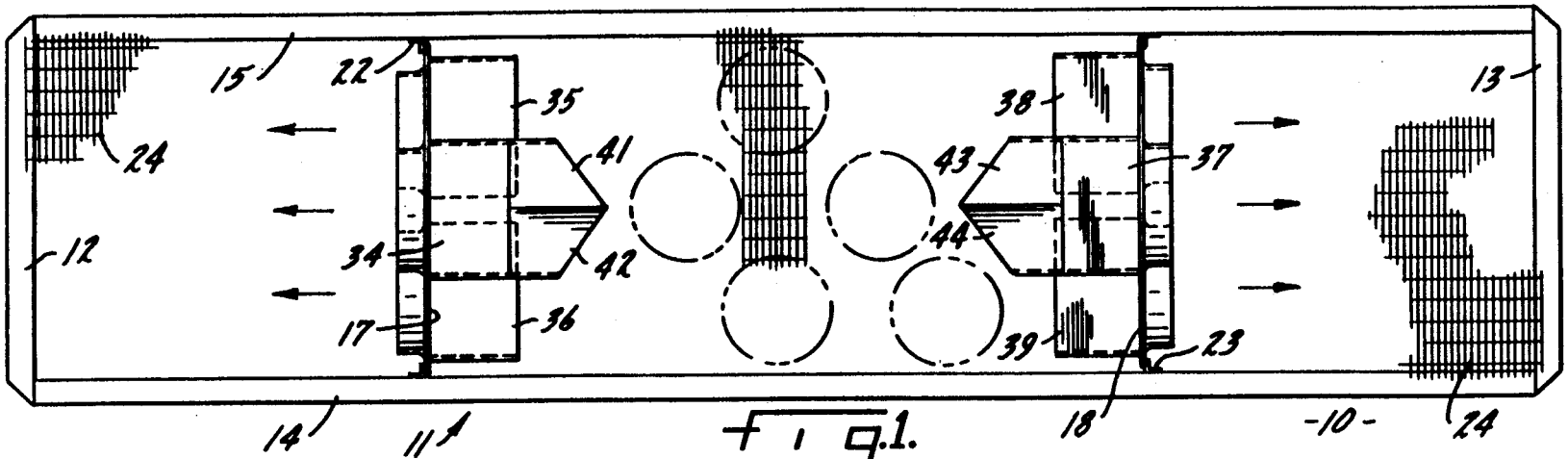
FIG. 1 is a top plan view of a structure and apparatus of the present invention with work pieces shown in phantom for clarity.

Like reference numerals will be used to refer to like parts from Figure to Figure in the drawing.

Figure 2:
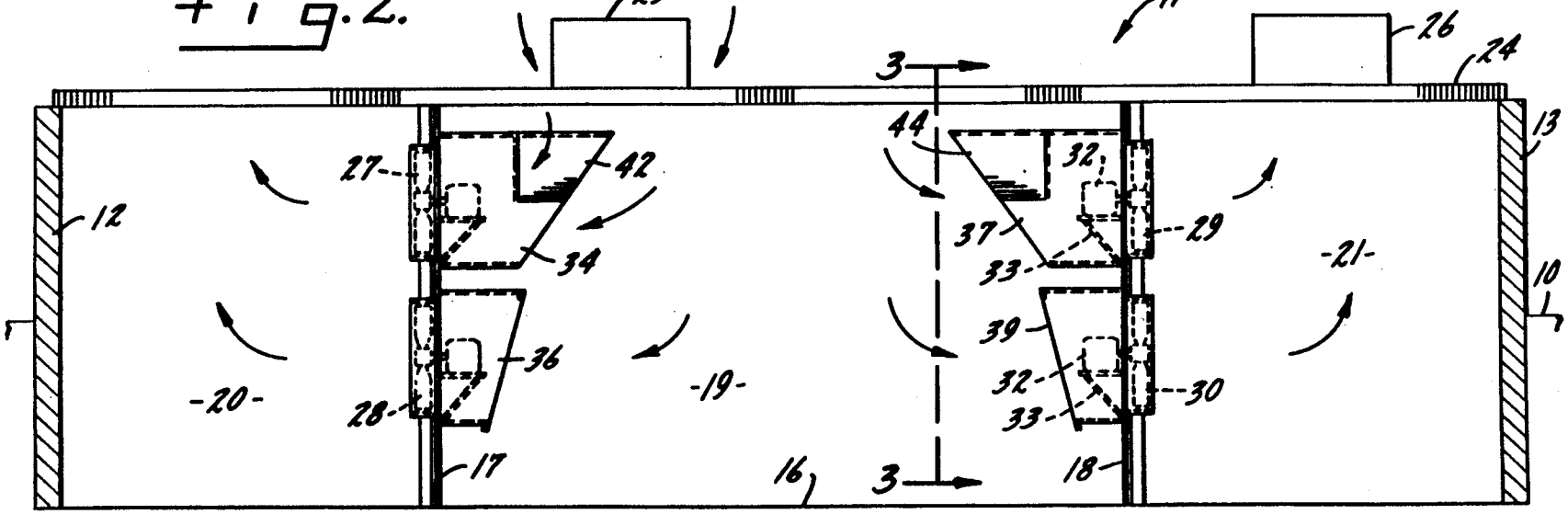
FIG. 2 is a vertical section view through the structure and apparatus of FIG. 1 showing the paths of the forced air drafts.

Referring first to FIGS. 1 and 2, the ground level in a heat treatment area is indicated at 10. A forced air quench tank is indicated generally at 11, the tank 11 including end wall 12, 13 and side walls 14, 15 which, as best illustrated in FIG. 2, extend above the ground level 10 to about a waist high level. The closed bottom is indicated at 16.

A pair of diaphragms, or internal walls, are indicated at 17 and 18, the diaphragms extending completely from side to side and upwardly to the top level to the side and end walls. The diaphragms divide the tank into a center, or down draft, section 19, and two end, or updraft sections, 20, 21. The diaphragms are held in place by bolts or other suitable fasteners secured in vertical L-shaped brackets, two of which are indicated at 22, 23, which are fast with the side walls 15 and 14. A grate having a series of thin longitudinal stringers and shorter cross struts is indicated at 24, the grate extending over the entire open area formed by the side and end walls, and being of a size and strength sufficient to support a large number of work pieces 25, 26 which will be referred to in greater detail hereinafter.

Figure 3:
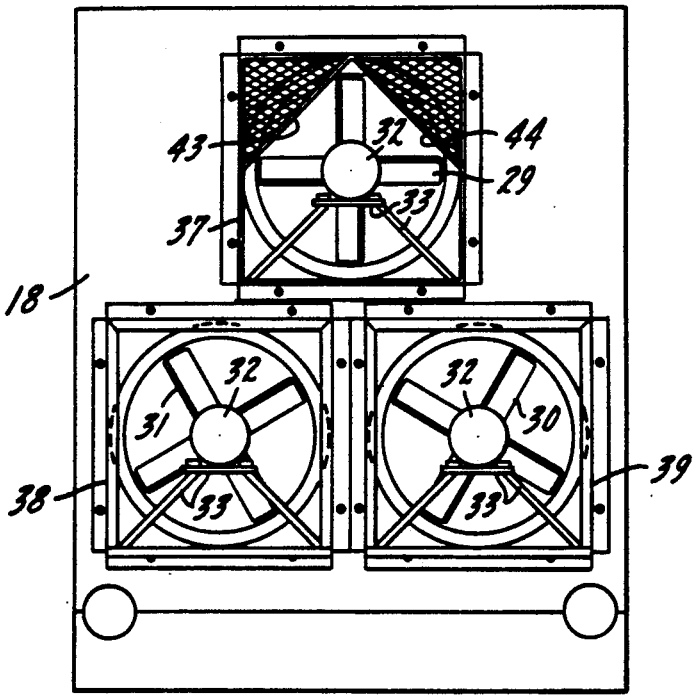
FIG. 3 is a view taken substantially along the line 3—3 of FIG. 2.

A plurality of fluid movers, in this instance propeller fans, are indicated at 27, 28 and 29, 30 and 31, see also FIG. 3. The fans are clustered in two groups of three each, one group in each diaphragm, in a triangularly stacked pattern as best seen in FIG. 3. Since each group is identical to the other, though reversed in position, a description of one will suffice as a description of both.

Referring then to the group of fans associated with diaphragm 18, it will be seen that the propeller of each fan is driven by a motor 32 mounted on a support structure 33. A housing surrounds each fan and projects inwardly toward the center of the tank, that is, the down draft section, said housings, or hoods, being indicated at 34, 35, 36 and 37, 38, 39. As best seen in FIG. 2, upper hoods 34 and 37 project inwardly toward the center of the tank substantially beyond the extreme inner ends of the bottom hoods so as to avoid the movement of a disproportionately large portion of air through the upper hoods. Each upper hood has a pair of angle plates 41, 42 and 43, 44 which serve to deflect scale which drops through the grate 24, and prevent the scale from entering and fouling the lower fans.

Figure 4:
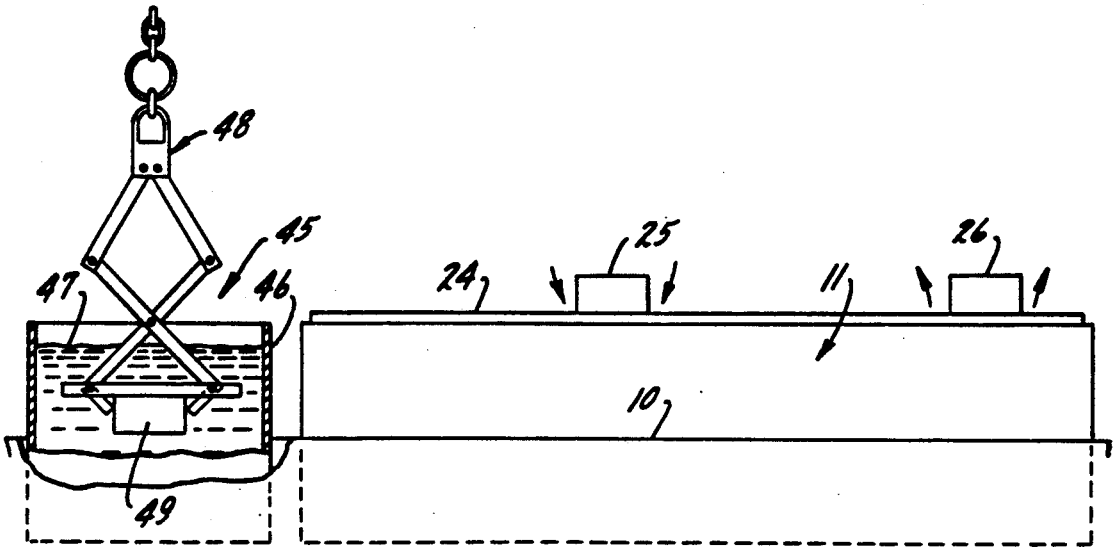
FIG. 4 is a side view with portions broken away for clarity of another embodiment of the invention.

In FIG. 4 the pure forced air quench system of FIGS. 1-3 has been modified by the addition of a liquid prequench indicated generally at 45. The liquid quench includes a quench tank 46 which is filled to a suitable level with a liquid quenching liquid 47 such as water or oil. A work piece lifting mechanism, herein ice-tong type gripper 48, immerses, and thereafter removes, a work piece 49 from the quench liquid after a predetermined time dwell interval.

The use and operation of the invention is as follows.

Redraws and retreats of hot formed work pieces, such as forgings, are significantly reduced, and double melt quality will be approached or attained in a single melt process by use of the instant invention.

Hot work pieces 25, 26, to be air cooled, are placed on the grate 24. Each piece is spaced a substantial distance from its neighbors as illustrated in phantom in FIG. 1. In this instance, a number of rounds, each about 12" in diameter, have been shown as exemplary. It will be understood, however, that there is no limitation to the size or shape of work pieces that can be treated. However, whatever the size or shape, sufficient clearance must be left between the work pieces to permit scale which forms thereon during the treatment to be periodically knocked off.

In one actual embodiment in which the diameter of the air quench tank was about six feet by twenty-four feet, the diaphragms 17 and 18 were placed to create two end sections of about six feet by six feet and a center section of about six feet by twelve feet. Two horse power motors were employed for each of the six fans which resulted in a movement of about 70,000 CFM which results in an air speed of about 11½ MPH. It is believed that air movement of at least about 10 MPH is very satisfactory, assuming the illustrated spacing. Such a relation between speed of air and spacing will ensure that slack quenching is avoided, especially if the operator takes care during the operation to remove scale as it forms.

As scale is removed from the work pieces, some will come to rest on the upper face of the grate and be conveniently available for later removal. Other, smaller pieces will fall through the grate. In order to eliminate movement of the small scale into the propellers, rounded hoods 34–40 extend outwardly a distance sufficient to generate a movement path of the scale particles which avoids the fans. The use of the relatively low speed of about 10 MPH also helps ensure that the scale will fall to the bottom 16, and not come into contact with the fans.

Of particular importance is the fact that the invention provides two pass cooling. Thus, with the fans rotating in a direction to suck air downwardly in the center, as illustrated by the arrows of FIG. 2, work pieces on the center section of the grate will be cooled on the downdraft, and other pieces resting on the grate above the end chambers 20, 21 will be cooled on the updraft. The two pass cooling arrangement saves valuable floor space and ensures that the heated air will be discharged vertically, and not into the shop area. It will be noted that the velocity of the moving air can be controlled by covering a portion of the grate over one or more of the three chambers. A further advantage of the two pass draft system is that the horsepower requirements of the illustrated system are only one half of what would be required in a one pass system; i.e.: in the illustrated embodiment, 18 horsepower versus 36. It should also be noted that the fans are so sized to the work pieces being treated that the fans are not subjected to undesirable temperature increases due to the heat of the closely adjacent work pieces. Should the fans become too hot, fan life decreases significantly.

It will be seen that the grate or grid permits constant velocity air (due to the constant suction in the center and the constant pressure on the ends), to enter the grates and reach the underfaces of the work pieces as well as making contact by eddy and thermal currents. The result is that all of the six basic contact areas, top, bottom, and four sides, will be uniformly quenched at a uniform rate of speed.

The degree to which performance improvements can be made by use of the invention is apparent from the following table. The type of steel treated in both the base year and the experimental period was either identical or similar on the basis of nominal compositions. As will be noted, the reduction in both redraws and retreats was on the order of about 50% or more.

TABLE 1

| | Base Year | Experimental Period (approx. ½ year) |
|---|---|---|
| % Pieces Redrawn | 180% | 71% |
| % Pieces Retreated | 89% | 45% |

In essence, the air speed should be high enough to always maintain a definite flow along a definite path, yet low enough to require minimum horse power and avoid blowing small particles of scale into the environment around the heat treat area.

As an example of the consistency of uniformity of hardness obtained by use of the invention, note the following results on a CrMo steel having a nominal composition of C. 33–0.39; Mn 0.50–0.70; Si 0.75–1.10; Cr 4.75–5.25; and Mo 1.70–2.00.

TABLE 2

| S.O. 32156 S-660 BHN |
|---|
| 363-388-388 |
| 388-388-388 |
| 375-375-375 |
| 375-375 |

Eleven pieces from the same heat of steel which had been processed in identical fashion as a group up to the first draft air quench described herein were checked to yield the above results.

Figure 5:
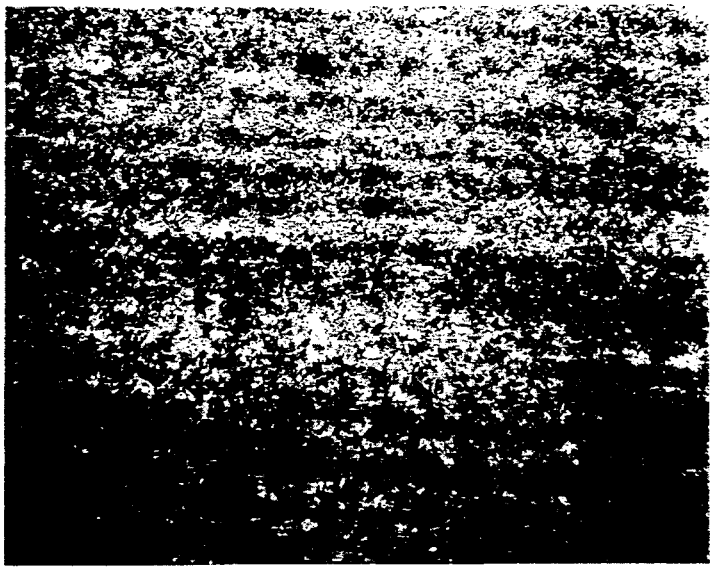
FIG. 5 is a photomicrograph of a section of a steel part treated in accordance with the present invention when used in conjunction with a single melt melting process.
Figure 6:
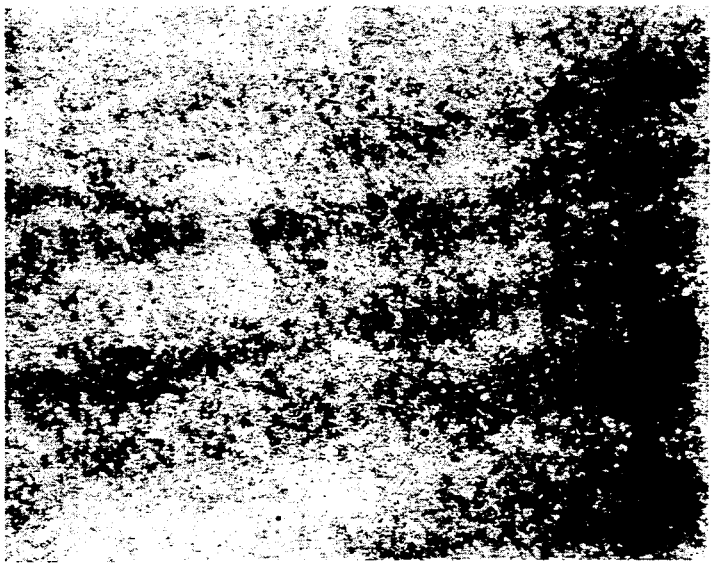
FIG. 6 is a photomicrograph of a section of a steel part of the same nominal composition as the part of FIG. 5 which was treated in accordance with the VAR process.

The particular utility of the invention when practiced in conjunction with the vacuum arc degassing processing is illustrated in FIGS. 5 and 6. For ease of understanding, it may be assumed that the steel in FIG. 5 was processed in accordance with the practice shown in U.S. Pat. No. 3,501,289, the disclosure of which patent is incorporated herein by reference. The steel illustrated in FIG. 6 was a steel of the same nominal composition as the steel of FIG. 5, but was processed in a vacuum arc remelt furnace. From a comparison of the photo micrographs it will be noted that the alloy segregation is only very slightly more pronounced in the single melted vacuum arc degassed processed steel of FIG. 5 as contrasted to the VAR melted steel of FIG. 6. Further comparisons between these two types of steel forming processes disclose that vacuum arc degassed single melted steel processed in accordance with this invention met all of the Chrysler Automotive Corporation's H13 requirements on all points except that the Type D inclusions (i.e.: the globular oxides) have a JK count of 1.5 instead of 1.0, all as based on a scale of 1–5.

In the practice of the embodiment of FIG. 4, an elevated temperature work piece is first immersed in a liquid quench and maintained therein until an appropriate intermediate temperature is reached. When said intermediate temperature is reached, the work piece is removed and placed on grate 24 and the above described forced draft air cooling process employed until the quenching process is complete. In one application, a 13½" diameter by 7" blank was treated as illustrated using a one-third normal liquid quench time, followed by the described forced draft cooling. Specifically, the liquid quench was applied until the work piece cooled to about 800° F. The subsequent forced air cooling caused a slower uniform temperature reduction to occur until the desired martinsitic microstructure was obtained. Thermal stresses at the 800° F. and lower temperature levels are accordingly reduced.

In application the invention can be applied to air hardening steels, shock resisting steels such as AISI S7, hot work chromium steels such as H-11 and H-13 and other grades having air hardening characteristics similar to the above.

Although a preferred embodiment of the invention has been illustrated and described, it will at once be apparent to those skilled in the art that variations and modifications may be made within the scope of the invention. Accordingly, it is intended that the scope of the invention be limited solely by the scope of the appended claims when interpreted in light of the relevant prior art.

We claim:

1. In a method of processing a plurality of stationary steel work pieces exposed to the ambient atmosphere, the steps of disposing a portion of said plurality of work pieces in a first location, disposing a portion of said plurality of said work pieces in a second location, subjecting said work pieces in said first location to a draft of forced air moving in a generally vertical direction, and subjecting said work pieces in said second location to a draft of forced air moving in a generally upward direction, at least two or more of said work pieces in each location being juxtaposed sufficiently close to one another to be subject to slack quenching in the absence of said draft of forced air.

2. The method of claim 1 further characterized in that said drafts of forced air flow at a rate of no less than about 10 mph.

3. The method of claim 2 further characterized in that all of said work pieces are supported in a position wherein all major surfaces of each of said work pieces is either directly exposed to said continuous forced air draft or to eddy currents derived therefrom.

4. The method of claim 2 further characterized in that all of said work pieces are spaced sufficiently far apart as to enable scale on said work pieces to be accessed and removed by workman in ambient atmosphere during exposure to the forced air draft.

5. The method of claim 1 further characterized in that said work pieces are produced in a single melt forming process which comprises subjection to vacuum, induced agitation and subjection to electrically generated heat using inclusion control techniques.

* * * * *